United States Patent [19]

Silva et al.

[11] 4,358,708

[45] Nov. 9, 1982

[54] LIGHT EMITTING DIODE ASSEMBLY

[75] Inventors: Joseph A. Silva, Brooklyn; Paul Manchenko, New Hyde Park, both of N.Y.

[73] Assignee: North American Philips Corporation, New York, N.Y.

[21] Appl. No.: 140,637

[22] Filed: Apr. 15, 1980 (Under 37 CFR 1.47)

[51] Int. Cl.[3] ..... H01J 7/44; H01J 13/46; H01J 19/78; H01J 29/96

[52] U.S. Cl. ..... 315/58; 313/318; 313/512; 315/49; 362/363; 362/374

[58] Field of Search ..... 315/46, 49, 58, 71; 313/512, 318; 362/362, 363, 364, 374, 375

[56] References Cited

U.S. PATENT DOCUMENTS

| | | | |
|---|---|---|---|
| 2,561,115 | 7/1951 | Stoffel | 315/71 X |
| 3,604,918 | 9/1971 | Cook et al. | 362/363 |
| 3,863,075 | 1/1975 | Ironmonger et al. | 313/512 |
| 3,887,803 | 6/1975 | Savage, Jr. | 362/363 |
| 4,107,768 | 8/1978 | Lemkin | 362/363 |
| 4,254,405 | 3/1981 | Wenzlaff | 362/362 |
| 4,257,085 | 3/1981 | Kimmel | 362/361 |

*Primary Examiner*—Saxfield Chatmon, Jr.
*Attorney, Agent, or Firm*—Robert J. Kraus; Marc D. Schechter; Joseph P. Abate

[57] ABSTRACT

A lamp assembly includes a lamp and a lamp package. The lamp includes a light-emitting portion with a flange at its base and electrically conducting leads extending from the base. The flange has a flat portion. The lamp package includes a cylindrical housing and a cylindrical cover. The housing has a base and a side wall, the base having holes for the electrical leads to pass therethrough, the bore in the housing being smaller than the flange of the lamp. A portion of the side wall of the housing has a flat key for engaging the flat portion of the flange. The cover has a side wall and an inwardly extending flange such that when the cover is slid over the lamp and the housing, the inwardly extending flange engages the outwardly extending flange of the lamp thereby holding it in place against the top of the housing and against the flat key of the housing.

13 Claims, 6 Drawing Figures

LIGHT EMITTING DIODE ASSEMBLY

BACKGROUND OF THE INVENTION

The invention relates to lamp assemblies and lamp holders for use with solid state lamps, such as light emitting diodes or other types of lamps.

Light emitting diodes, as heretofore known, have on occasion consisted of active components embedded in a domed cylindrical light-transmitting portion with a base. The base included a flange and two electrically conducting leads extending from the base away from the light-transmitting portion. The flange was substantially uniform throughout the entire circumference of the base except for a flat portion to indicate polarity.

It has also often been desirable to provide a direct substitution of a light emitting diode for a different type of lamp in an existing circuit board. In such cases it may be necessary to add a resistor to the lamp circuit in series connection with the light emitting diode in order to limit the current through the diode. Thus, the addition of this component complicates manufacturing and use of the assembly. Such an LED-resistor combination is known from DIALIGHT Catalogue SG 753, page 23, February, 1978, The LED is combined with a built-in resistor (on a semiconductor chip) and pins, molded in epoxy in a plastic package.

SUMMARY OF THE INVENTION

Accordingly, it is an object of the invention to provide an improved package for a light emitting diode which has a resistor electrically connected in series to at least one of its leads.

Another object of the invention is to provide a lamp package which prevents the rotation of the lamp within the package, so that the electrically conducting leads cannot become twisted and contact each other.

Yet another object of the invention is to provide a lamp package which is capable of accepting lamps with varying dimensions yet which prevents rotation of any of these lamps within the package.

A further object of the invention is to provide an improved lamp assembly which is capable of being a direct substitution for an existing lamp in an existing circuit board.

An improved lamp assembly according to the present invention includes a lamp, a cylindrical housing, and a cylindrical cover. The lamp has a cylindrical light-emitting portion with a base comprising an outwardly extending flange. The flange has a flat portion. At least one electrically conducting leads extends from the base of the lamp in a direction away from the light-emitting portion. The housing has a base and a side wall, the base having an opening for the insertion of the conducting lead of the lamp. The bore of the housing is smaller than the outer diameter of the flange so that the flange cannot be inserted into the housing. A portion of the housing has a flat key. The lamp is placed on the side wall of the housing with the lead passing through the opening of the housing and the flat key engaging the flat portion of the flange. The cover has two ends, a side wall, and an inwardly extending flange at one end. The bore of the cover is slightly larger than both the outer diameter of the housing and the flange. The bore of the flange of the cover is less than the outer diameter of the flange. The cover is placed over the housing and the lamp such that the inwardly extending flange engages the outwardly extending flange, thereby holding the lamp onto the side wall of the housing.

An improved lamp package according to the present invention, for holding a lamp having a cylindrical light-emitting portion with a base comprising an outwardly extending flange, said flange having a flat portion, includes a cylindrical housing and a cylindrical cover, as described above.

DESCRIPTION OF THE PREFERRED EMBODIMENTS

Figure 2:
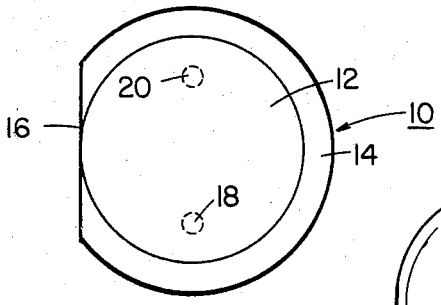
FIG. 2 is a top plan view of the light emitting diode of FIG.1.
Figure 1:
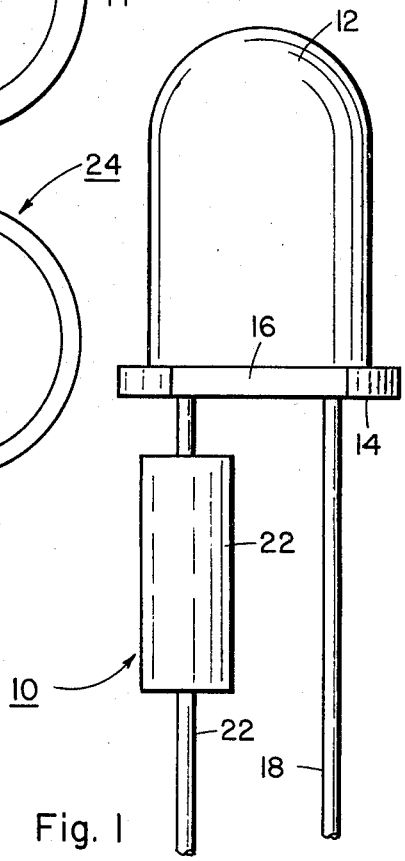
FIG. 1 is a side elevation view of a light emitting diode which may be mounted in the lamp package according to the present invention and which may be a part of the lamp assembly according to the present invention.

Referring to FIGS. 1 and 2, there is shown a lamp 10 which may be part of a lamp assembly according to the present invention or which is suitable for mounting in a lamp package according to the present invention. Lamp 10 includes a cylindrical light-emitting portion 12 which is preferably circular cylindrical, but may take other forms. At the base of light-emitting portion 12 is an outwardly extending flange 14. As can be seen more clearly in FIG. 2, flange 14 has a flat portion 16 whose function will be explained below.

Extending from the base of light-emitting portion 12, in a direction away from the light-emitting portion 12, are two electrically conducting leads 18 and 20. Lead 20 is longer than lead 18 in order to indicate polarity. Depending upon the particular type of lamp used, and depending upon whether the substrate of the lamp is electrically conducting, the lamp 10 may have only one electrically conducting lead or may have more than two electrically conducting leads.

As seen in FIG. 1, electrically conducting lead 20 contains a biasing resistor 22 integral therewith. This biasing resistor 22 is electrically connected in series with the two portions of electrically conducting lead 20 on either side of the resistor. Resistor 22 could alternatively have been provided on lead 18, if desired.

Lamp 10 is preferably, a light-emitting diode, for example, General Instrument catalogue number MV5752 or Hewlett-Packard catalogue number 5082-4658. Both of these LED's are nominally rated for operation at 15 mA and 2 V. When a 150 ohm biasing resistor is added, for example, the combination is nominally rated for operation at 15 mA and 5 V. Additionally, both of these LED's are manufactured with the flange at the base, and with the flat portion of the flange as standard features.

The value of the biasing resistor may be chosen to achieve any desired operating voltage. As discussed above, a 150 ohm resistor is suitable for 5 V operation.

The biasing resistor may be welded to the electrically conducting lead by resistance welding, which technique is well known to those skilled in the art.

Figure 3:
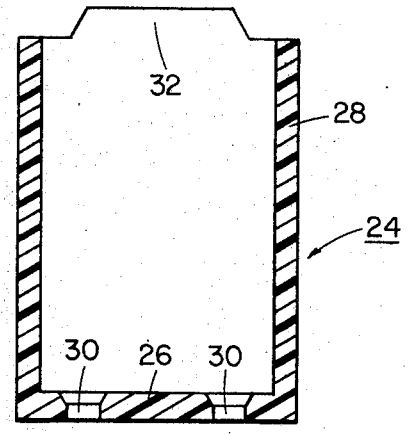
FIG. 3 is a cross-sectional view of a housing portion of the lamp assembly or lamp package according to the present invention.
Figure 4:
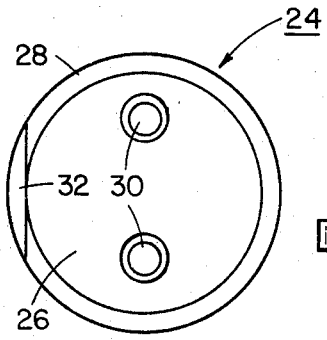
FIG. 4 is a top plan view of the housing of FIG. 3.

Referring to FIGS. 3 and 4, there is shown a cylindrical housing 24 for use in the lamp assembly or the lamp package according to the present invention. Housing 24 is preferably circular cylindrical, however it may take other forms. Housing 24 is made up of a base 26 and side wall 28. The bore of the housing 24 is smaller than the outer diameter of the flange of the lamp so that the flange cannot be inserted into the housing.

Base 26 of housing 24 is provided with openings 30 through which the conducting leads 18 and 20 of the lamp 10 can be passed. Openings 30 are preferably beveled, as shown in FIG. 3, to facilitate the insertion of conducting leads 18 and 20 therethrough.

Side wall 28 of housing 24 is provided with a flat key 32 projecting slightly above a portion of the side wall. As will be more fully described below, flat key 32 is designed to engage the flat portion 16 of flange 14 of lamp 10 so as to prevent relative rotation between lamp 10 and housing 24.

Figure 5:
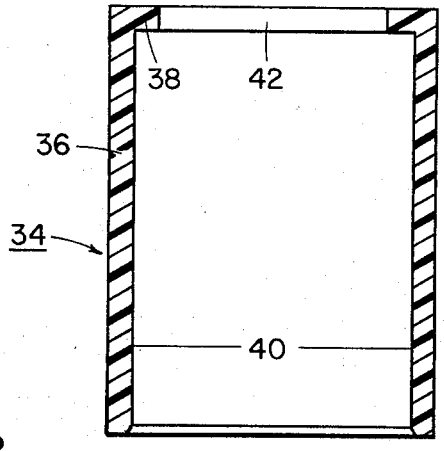
FIG. 5 is a cross-sectional view of the cover of the lamp assembly or lamp package according to the present invention.

Referring to FIG. 5, there is shown a cylindrical cover 34 for use in the lamp assembly and the lamp package according to the present invention. Cover 34 is preferably circular cylindrical, however it may take other forms. Cover 34 has a side wall 36 with two ends. At one end of side wall 36 there is an inwardly extending flange 38. The bore 40 of the cover is slightly larger than both the outer diameter of the housing 24 and the flange 14 of the lamp 10, so as to allow the cover 34 to be slid over both flange 14 of lamp 10 and housing 24. The bore 42 of the flange 38, however, is less than the outer diameter of the flange 14 of lamp 10.

Both housing 24 and cover 34 are preferably made of a nylon or polyester material, for example, Valox (trademark) 310 made by General Electric. The material is shaped by injection molding, which method is known to those with ordinary skill in the art.

Figure 6:
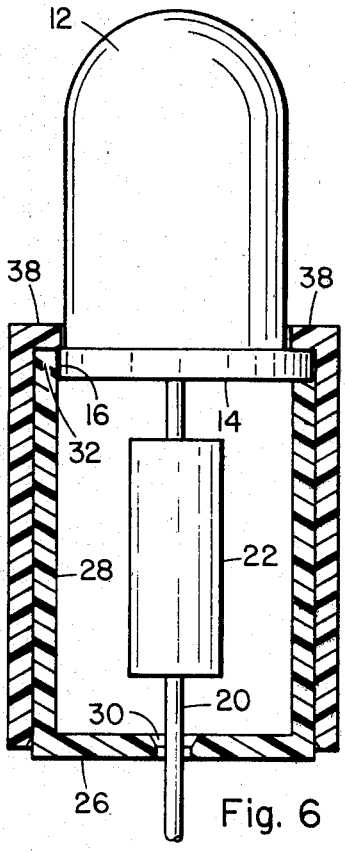
FIG. 6 is a side elevation view, partially in cross-section, of a lamp assembly, including a lamp package, according to the present invention.

In operation, the housing 24 and cover 34 are assembled as shown in FIG. 6 to form a lamp package according to the present invention, and in combination with the lamp 10 they provide a lamp assembly according to the present invention.

In order to obtain the structure shown in FIG. 6, conducting leads 18 and 20 of lamp 10 are first inserted inside side wall 28 of housing 24 and through openings 30 in base 26 thereof. The positions of the openings 30 in base 26 must correspond with the positions of the leads 18 and 20 on the base of the lamp 10 when the flat key 32 on housing 24 is engaged with the flat portion 16 of flange 14 of lamp 10. Lamp 10 is inserted into housing 24 until the integral biasing resistor 22 is fully enclosed within housing 24 and until the base of light-emitting portion 12 rests on top of side wall 28. At this time, flat portion 16 of flange 14 must engage flat key 32 of housing 24. If flat portion 16 does not engage flat key 32, then lamp 10 should be removed from housing 24 and rotated 180° and then reinserted.

After lamp 10 has been inserted into housing 24, cover 34 is placed over lamp 10 with bore 40, larger than bore 42 facing downward. Cover 34 is slid downward over both lamp 10 and housing 24 until inwardly extending flange 38 contacts outwardly extending flange 14 of lamp 10. This package or assembly may then be permanently fastened together by such well known methods as ultrasonic welding or an epoxy adhesive. Alternatively, the package may include locking tabs (in the form of slots in the cover and protrusions in the housing) which simply snap together.

As a result of the lamp package and lamp assembly according to the invention, shown in FIG. 6, lamp 10 is rigidly held in housing 24. Lamp 10 cannot rotate with respect to housing 24 due to the fact that flat portion 16 of flange 14 is engaged with flat key 32. Conducting leads 18 and 20 cannot rotate with respect to housing 24 because they are engaged in openings 30. Lamp 10 cannot move laterally or up and down with respect to housing 24 due to the side wall 36 and flange 38 of cover 34.

The lamp assembly and package according to the present invention may be used with lamps of various dimensions, yet still maintaining the rigid mounting of the lamp within the package or assembly. It is only necessary that any lamp used have a flange 14 with a diameter larger than both the bore of housing 24 and the bore 42 of cover 34, and that the light-emitting portion 12 of the lamp must be small enough to fit within flange 38 of cover 34.

Biasing resistor 22 is preferably provided as part of lamp 10 when lamp 10 is a light-emitting diode. In many existing circuit boards, which originally contained incandescent type lamps, the voltages supplied at the lamp sockets are too large for use with light-emitting diodes. Accordingly, by supplying a biasing resistor, electrically connected in series with the light-emitting diode, the combination can be directly inserted into a circuit board as a substitution for an incandescent lamp. Biasing resistor 22 assures that the voltage which is actually applied to the light-emitting diode will not be excessive.

Modifications and variations of the present invention, beyond those discussed above, will be apparent to one with ordinary skill in the art. Such modifications and variations are intended to come within the scope of the claims below.

We claim:

1. A lamp assembly, of the type comprising a lamp in a package, said lamp having a cylindrical light-emitting portion with a base, said base comprising an outwardly extending flange, said flange having a flat portion, said lamp having at least one electrically conducting lead extending from the base in a direction away from the light-emitting portion, characterised in that said package comprises:

a cylindrical housing having a base and a side wall, said base having an opening for the insertion of the conducting lead, the inner diameter of the housing being smaller than the outer diameter of the flange of the lamp so that the flange cannot be inserted into the housing, a portion of the side wall of the housing being provided with a flat key, said lamp being placed on the side wall of the housing with the lead passing through the opening in the base and the flat key engaging the flat portion of the flange; and a cylindrical cover having two ends, said cover having a side wall and an inwardly extending flange forming a bore at one end thereof, the inner diameter of the cover being slightly larger than both the outer diameter of the housing and the flange of the lamp, the bore diameter being smaller than the outer diameter of the flange of the lamp, said cover being placed over the housing and the outwardly extending flange of the lamp such that the inwardly extending flange of the cover engages the outwardly extending flange of the lamp, thereby holding the lamp onto the side wall of the housing.

2. A lamp assembly, as claimed in claim 1, wherein:

the lamp has at least two electrically conducting leads extending from its base in a direction away from the light-emitting portion;

the base of the housing has at least as many openings as the lamp has electrically conducting leads, each opening being for the insertion of one lead; and the positions of the openings correspond with the positions of the leads on the base of the lamp when the flat key on the housing is engaged with the flat portion of the flange of the lamp.

3. A lamp assembly, as claimed in claim 2, wherein at least one lead is provided with an integral biasing resistor which is located within the housing.

4. A lamp assembly, as claimed in claim 3, wherein the light-emitting portion of the lamp, the housing, and the bore cover are circular cylindrical.

5. A lamp assembly, as claimed in claim 4, wherein the cover is fastened to the housing.

6. A lamp assembly, as claimed in claim 5, wherein the cover is permanently fastened to the housing.

7. A lamp assembly, as claimed in claim 4, wherein the openings in the base of the housing are beveled to facilitate insertion of the leads therethrough.

8. A lamp package, for holding a lamp having a cylindrical light-emitting portion with a base, said base comprising an outwardly extending flange, said flange having a flat portion, said lamp having at least one electrically conducting lead extending from the base in a direction away from the light-emitting portion, comprising:

a cylindrical housing having a base and side wall, said base having an opening for the insertion of the conducting lead, the inner diameter of the housing being smaller than the outer diameter of the flange of the lamp so that the flange cannot be inserted into the housing, a portion of the side wall of the housing being provided with a flat key which, in operation, engages the flat portion of the flange when the lamp is placed on the side wall of the housing; and a cylindrical cover having two ends, said cover having a side wall and an inwardly extending flange forming a bore at one end thereof, the inner diameter of the cover being slightly larger than both the outer diameter of the housing and the flange of the lamp, the bore diameter being smaller than the outer diameter of the flange of the lamp, wherein, in operation, said cover is placed over the housing and the outwardly extending flange of the lamp such that the inwardly extending flange of the cover engages the outwardly extending flange of the lamp, thereby holding the lamp onto the side walls of the housing.

9. A lamp package, as claimed in claim 8, for holding a lamp which has at least two electrically conducting leads extending from its base in a direction away from the light-emitting portion, wherein:

the base of the housing has at least the same number of openings as the lamp has leads, each opening for the insertion of one lead; and in operation the positions of the openings correspond with the positions of the leads on the base of the lamp when the flat key on the housing is engaged with the flat portion of the flange of the lamp.

10. A lamp package, as claimed in claim 9, wherein the housing and the cover are circularly cylindrical.

11. A lamp package, as claimed in claim 10, wherein after the lamp is placed into the package the cover is fastened to the housing.

12. A lamp package, as claimed in claim 11, wherein the cover is permanently fastened to the housing.

13. A lamp package, as claimed in claim 10, wherein the openings are beveled to facilitate insertion of the leads therethrough.

* * * * *